United States Patent [19]

Buss et al.

[11] 4,338,088

[45] Jul. 6, 1982

[54] FOLDING MACHINE

[76] Inventors: Randall D. Buss; Benjamin A. Buss, both of 1315 23rd Ave. Ct., East Moline, Ill. 61244

[21] Appl. No.: 828,302

[22] Filed: Aug. 29, 1977

[51] Int. Cl.[3] ..... B65H 45/04

[52] U.S. Cl. ..... 493/445; 414/80; 414/81

[58] Field of Search ..... 270/80–85, 270/67; 214/6 DK, 6 G, 6 H; 74/231 C; 414/80–81

[56] References Cited

U.S. PATENT DOCUMENTS

| | | | |
|---|---|---|---|
| 2,403,394 | 7/1946 | Preston | 270/82 |
| 3,190,640 | 6/1965 | Sjostrom | 270/82 |
| 3,774,903 | 11/1973 | Sjoman | 270/67 |
| 3,790,157 | 2/1974 | Crawford | 270/62 |
| 3,888,132 | 6/1975 | Russ | 74/231 C |
| 4,083,552 | 4/1978 | Sjoman | 270/85 |

*Primary Examiner*—Edgar S. Burr
*Assistant Examiner*—A. Heinz

[57] ABSTRACT

A folding machine for flat material such as bed sheets or blankets which folds the material into thirty-seconds, conveys the material to an integral stacker and stacks the same. The machine includes a positive drive to each of a pair of relatively movable folding rolls through a single belt which insures that the two rolls are driven at exactly the same speed. The conveyor also serves to smooth the material by removing wrinkles so that the folded material has an ironed look. The stacker is shaped to give the material extra rigidity so the conveyor can push the material onto the stacker and includes a pair of drop doors sized and positioned to achieve maximum stack height without increasing the size of the overall folding machine.

19 Claims, 10 Drawing Figures

FOLDING MACHINE

BACKGROUND OF THE INVENTION

The present invention relates generally to improvements in material-folding machines, and more specifically to improvements in machines for folding laundry articles such as bed sheets and blankets and the like.

The basic concept of utilizing pairs of folding rolls and a blade to move material between the rolls to obtain a fold has been known for a long time and is shown in such patents as U.S. Pat. No. 2,954,974 which issued to H. Kellett on Oct. 4, 1960, and Great Britain patent specification No. 1,377,089 published Dec. 11, 1974. Folding machines utilizing this concept have proven successful as long as the thickness of the material and the number of folds has been kept to a minimum. However, as the number of folds has increased and it has become common practice to fold materials of widely varied thicknesses, such as sheets and blankets, the machines have become overly complex due to the need to positively drive both rolls of at least the final pair and to drive them at equal speeds.

It has also been known to combine stackers with folding machines, but some such stackers have increased the size of the machines and others have not had a satisfactory means to move the folded material onto the stacker. Examples of stackers combined with folding machines can be seen in U.S. Pat. No. 3,190,640 which issued to R. L. Sjostrom on Jan. 22, 1965; U.S. Pat. No. 3,774,903 which issued to C. F. Sjoman et. al. on Nov. 27, 1973; U.S. Pat. No. 3,003,760 which issued to L. O. Scheu, Jr., et. al. on Oct. 10, 1961; and in U.S. Application Ser. No. 705,459 (now U.S. Pat. No. 4,057,241) which was filed July 15, 1976 as a continuation of application Ser. No. 546,924 which was filed on Feb. 4, 1975, now abandoned.

SUMMARY OF THE INVENTION

The broad object of the present invention is to provide a material-folding machine with an improved drive for the folding rolls and an improved stacker.

A specific object of the present invention is to provide a material-folding machine which utilizes a single belt to positively drive a pair of relatively movable folding rolls.

Another specific object of the present invention is to provide a folding machine with a combined stacker which utilizes a conveyor to move folded material onto the drop doors of the stacker, and in which the conveyor elevates the material up to the stacker so that a stack of maximum height can be obtained without increasing the dimensions of the overall folder.

Still another specific object of the present invention is to provide a material-folding machine with a combined stacker which utilizes a conveyor to move folded material onto the drop doors of the stacker and in which the conveyor is driven at a faster speed than the last pair of folding rolls so that it tends to pull any wrinkles out of the material as it emerges from between that pair of folding rolls.

Yet another specific object of the present invention is to provide a material-folding machine with a combined stacker which does not affect the size or overall dimensions of the basic folding machine.

A still further specific object of the invention is to provide a material-folding machine with a built-in stacker which pushes the material onto the drop doors of the stacker.

Another specific object of the present invention is to provide a material-folding machine with a combined stacker which utilizes a single belt for positively driving the last pair of relatively movable folding rolls and a conveyor for delivering material to drop doors of the stacker.

Still another specific object of the invention is to provide a material-folding machine with an integral stacker in which the drop doors of the stacker are specially constructed and mounted to require a minimum amount of space in which to move so that a stack of maximum height can be obtained.

The above objects and additional objects and advantages will become apparent to those skilled in the art from a reading of the following detailed description of a preferred embodiment of the invention when read in conjunction with the accompanying drawings.

DESCRIPTION OF A PREFERRED EMBODIMENT

Figure 1:
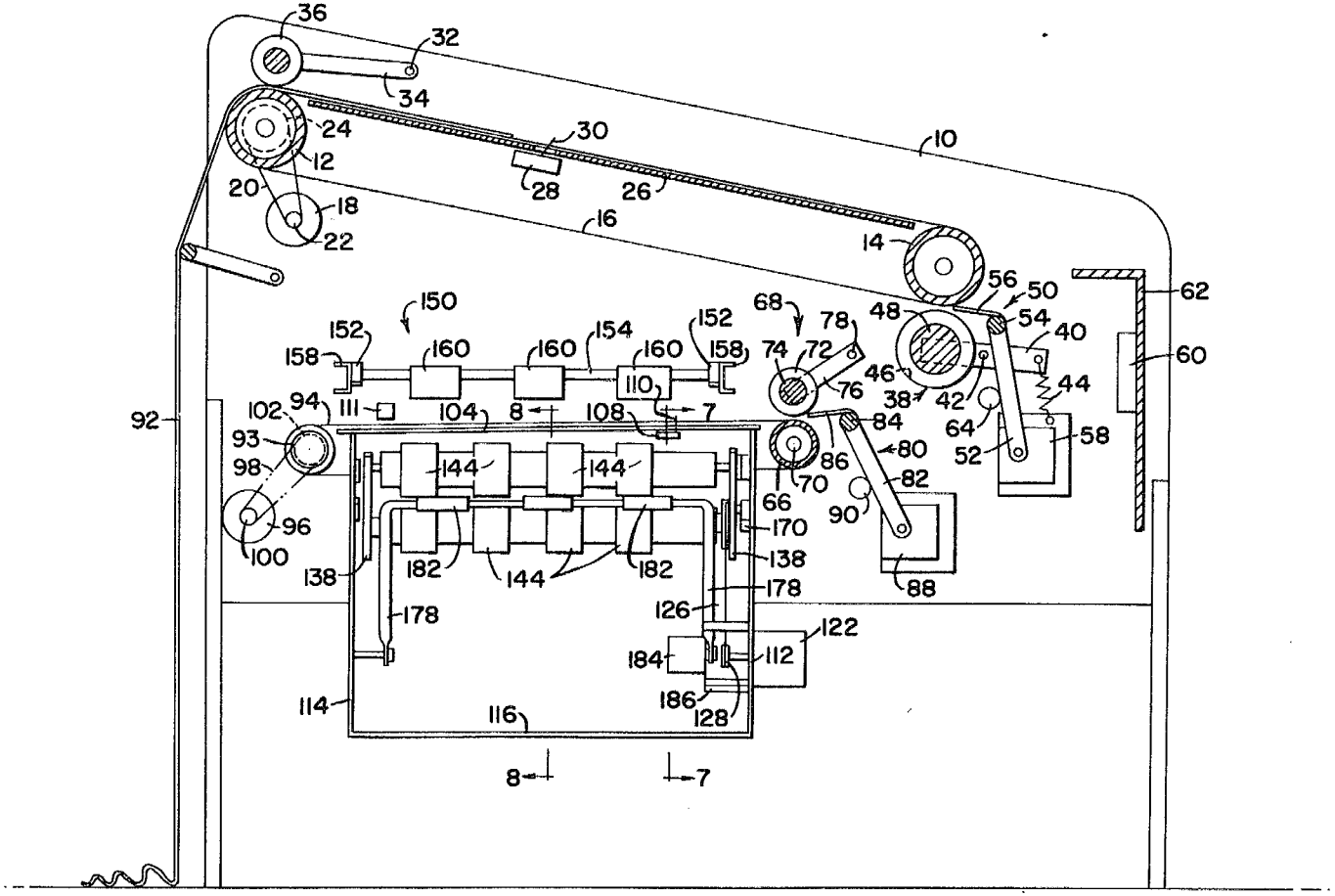
FIG. 1 is a vertical sectional view of a folding machine constructed in accordance with the principles of the present invention.

Referring to the drawings, sides 10 of a frame rotatably support transversely extending front and rear rolls 12 and 14 about which are trained a plurality of spaced, endless, flexible belts 16. Rolls 12 and 14 and belts 16 form a first conveyor. The front roll 12 is driven by a motor 18 through an endless belt 20 which is trained about pulleys 22 and 24 secured to the motor shaft and to roll 12 respectively. A bed 26 for the conveyor extends between the sides 10 of the frame and is positioned just beneath the upper reaches of the endless belts 16 to provide support therefore. A switch 28 is mounted to the bottom side of the bed 26 and includes an actuating finger 30 which extends upwardly through a suitable opening provided in the bed and passes between a pair of the belts 16. The purpose of the switch will be explained hereinafter.

A rod 32 extends between the sides 10 of the frame above the conveyor, and a plurality of arms 34 (only one shown) each have one end pivotally mounted on the rod 32. Each pair of arms 34 rotatably supports one or more short gripping rolls 36 which rest on the front conveyor roll 12.

The rear conveyor roll 14 and a roll 38 form a pair of quarter-fold rolls. The roll 38 is rotatably supported beneath the roll 14 by a pair of arms 40 pivotally mounted on the sides 10 as at 42. A tension spring 44 is anchored to each of the arms 40 and the respective side 10 and biases its respective arm 40 about the pivot 42 to bring the roll 38 into engagement with the roll 14. The roll 38 consists of a plurality of spaced sleeves 46 mounted on a central shaft 48.

A quarter-fold oscillatory blade assembly indicated generally at 50 completes the quarter-fold portion of the machine. The quarter-fold blade assembly includes a pair of arms 52 interconnected at one end by a rod 54 and pivotally mounted on the sides 10 at their opposite ends. Spaced blades 56 are secured to the rod 54 for movement between the sleeves 46 as the arms 52 pivot toward the roll 38. A reversible motor 58 mounted on a side 10 is secured to one of the arms 52 and controls the movement of the quarter-fold blade assembly. The quarter-fold blade assembly moves, under the control of the motor 58, between a forward position illustrated in FIG. 1 to a rearward position illustrated in FIGS. 3 and 4 in which it engages a bumper 60 on the rear wall 62 of the frame. A stop member 64 limits the forward movement of the quarter-fold blade assembly.

A pair of rolls 66 and 68 form a pair of eighth-fold rolls which are mounted on the frame in a position offset from the egress side of the quarter-fold rolls and at a level lower than the quarter-fold rolls. The roll 66 is mounted for rotation about a fixed axis 70 and is driven in a manner to be explained hereinafter. The roll 68, like the roll 38, consists of a plurality of spaced sleeves 72 mounted on a central shaft 74. The opposite ends of the shaft 74 are rotatably mounted on arms 76 which are pivotally mounted on the sides 10 by pins 78. The weight of the roll 68 normally keeps it in engagement with the roll 66.

An eighth-fold oscillatory blade assembly indicated generally at 80 completes the eighth-fold portion of the machine. The eighth-fold blade assembly includes a pair of arms 82 interconnected at one end by a rod 84 and pivotally mounted on the sides 10 at their opposite ends. Spaced blades 86 are secured to the rod 84 for movement between the sleeves 72 as the arms 82 pivot toward the roll 68. A reversible motor 88 mounted on one of the sides 10 is secured to one of the arms 82 and controls the movement of the eighth-fold blade assembly between a forward position against a stop 90 as illustrated in FIG. 1 and a rearward position against the stop 64 illustrated in FIG. 5.

The operation of the folding machine so far described is essentially as follows: the machine operator will place the leading edge of a sheet or blanket 92 between the conveyor roll 12 and gripper rolls 36. This can be done by two operators or by a single operator. The machine is then started and rotation of the driven roll 12 causes the sheet or blanket to be pulled between the rolls 12 and 36 and moved down the first conveyor toward the quarter-fold portion of the machine as shown in FIG. 1. When the sheet or blanket engages the finger 30 the switch 28 is actuated to start a timer mechanism. The timer mechanism per se does not form a part of the present invention and can be any conventional timer mechanism.

Figure 2:
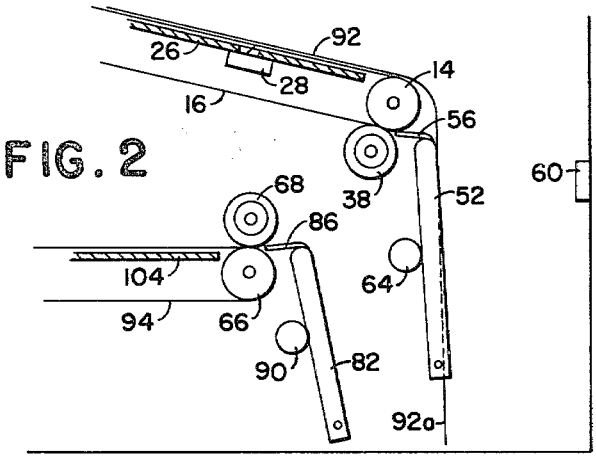
FIGS. 2–6 are diagramatic sectional views showing successive folding functions produced by the folding machine illustrated in FIG. 1.
Figure 3:
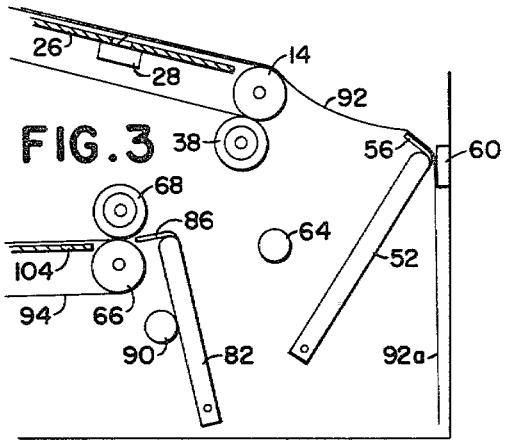
Figure 4:
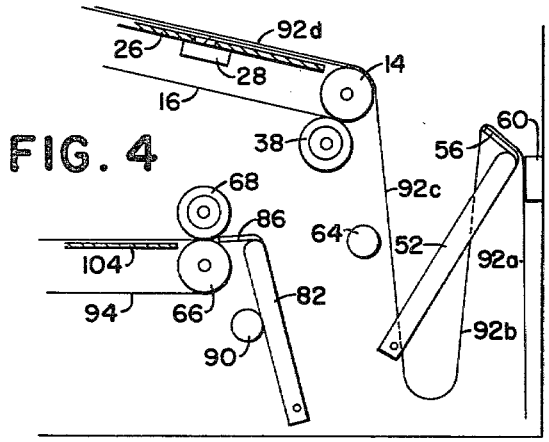
Figure 5:
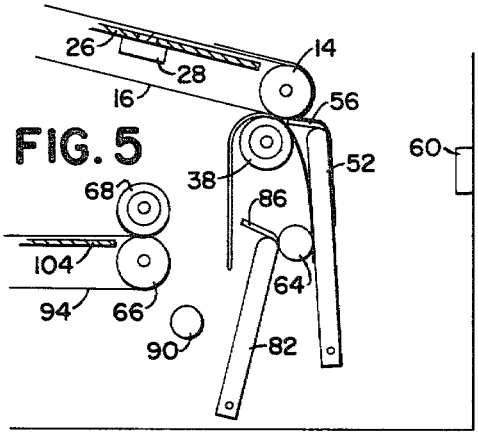

When a desired portion of the sheet or blanket, approximately one-quarter thereof, has dropped over the end of the first conveyor and passed by the rear edge of the blades 56 as illustrated at 92*a* in FIG. 2, the timer mechanism starts the reversible motor 58 to pivot the blade assembly 50 rearwardly so as to engage the sheet or blanket between the rear of the blades 56 and the bumper 60 as shown in FIG. 3. As the sheet or blanket continues to move off the first conveyor it drapes downwardly to form portions 92*b* and 92*c* as shown in FIG. 4. When the sheet or blanket portions 92*b* and *c* are each approximately one-quarter of the entire sheet or blanket and the portion 92*d* of the sheet or blanket remaining on the first conveyor is also approximately one-quarter of the entire sheet or blanket as shown in FIG. 4, the timer mechanism agains starts the reversible motor 58 to pivot the blade assembly forward as shown in FIG. 5. When the blade mechanism pivots forwardly the blades 56 engage the sheet or blanket and force it into the pinch points between the roll 14 and sleeves 46 so that rotation of the rolls 14 and 38 pulls the four sections of the sheet or blanket between the rolls to provide the quarter-fold as can be seen in FIG. 5.

Figure 6:
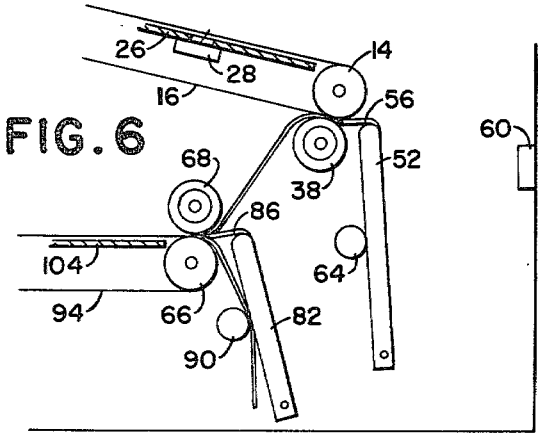

When the timing mechanism starts the reversible motor 58 to pivot the blade assembly 50 forward it also starts the reversible motor 88 to pivot the blade assembly 80 of the eighth-fold portion of the machine rearwardly as shown in FIG. 5. When approximately one-half of the quarter-folded sheet or blanket has passed by the blades 86, the timer mechanism again starts the reversible motor 88 to pivot the blade assembly 80 forward. The blades 86 engage the quarter-folded sheet or blanket approximately at the middle of the quarter panels and force it into the pinch points between the roll 66 and sleeves 72 so that rotation of the rolls 66 and 68 pulls the eight sections of the sheet or blanket between the rolls 66 and 68 to provide the eighth-fold as can be seen in FIG. 6.

A cross-fold portion of the machine provides two additional folding functions which fold the sheet or blanket 92 into sixteenths and thirty-seconds. The cross-fold portion of the machine includes a second conveyor made of the roll 66, a roll 93 and a plurality of spaced, endless, flexible belts 94 trained about the rolls 66 and 93. The roll 93 is rotatably mounted on the sides 10 and is driven by a motor 96 through an endless flexible belt 98 trained about pulleys 100 and 102 on the motor shaft and roll 93 respectively. Rotation of the roll 93 provides the hereinbefore mentioned rotation of the roll 66 through the belts 94.

A bed 104 for the second conveyor extends between the sides 10 of the frame and is positioned just beneath the upper reaches of the endless belts 94. As can best be seen in FIGS. 7 and 8, the bed 104 is provided with an elongated opening 106 which extends substantially parallel to the direction of movement of the second conveyor. A switch 108 is mounted to the underside of the bed 104 and includes an actuation finger 110 which extends upwardly through the opening 106 and between the belts 94. A stop bar 111 extends between the sides 10 and is positioned just above the belts 94 adjacent to the discharge end of the second conveyor.

A roll support frame depends from the bed 104 and includes a pair of side walls 112 and 114 interconnected by a bottom wall 116. A pair of sixteenth-fold rolls 118 and 120 are mounted between the side walls 112 and 114 in side-by-side relationship with their axes substantially parallel to the direction of movement of the conveyor and with the pinch point between the two rolls substantially centered with respect to the opening 106.

The roll 118 is mounted for rotation about a fixed axis and is driven by a motor 122. The drive from the motor 122 to the roll 118 includes a roller 124 which is driven by the motor 122 through an endless flexible belt 126 trained about pulleys 128 and 130 mounted on the motor shaft and roller 124 respectively. The roller 124, in turn, drives the roll 118 through an endless flexible belt 132 trained about pulleys 134 and 136 mounted on the roller 124 and roll 118 respectively.

The roll 120 has its opposite ends rotatably mounted on the ends of a pair of arms 138 which are pivotally mounted intermediate their ends to the side walls 112 and 114 by pins 140. The roll 120 is loosely mounted on the arms 138 or is mounted through universal journals so that the opposite ends of the roll 120 can move relative to each other and the roll 120 can assume a canted position with respect to the roll 118. A spring 142 is anchored to the free ends of each of the arms 138 and to the respective side wall 112 and 114 and acts on the arm 138 to bias the roll 120 toward and into engagement with the roll 118. Each of the rolls 118 and 120 is provided with a plurality of aligned rubber sleeves 144.

A sixteenth-fold oscillatory blade assembly indicated generally at 150 includes a pair of arms 152 interconnected by a rod 154 at one end and pivotally mounted on brackets 156 at their opposite ends. The brackets 156 are secured to a pair of spaced rails 158 extending between the sides 10 above the second conveyor. A plurality of spaced blades 160 are secured to the rod 154 for movement between the sleeves 144 on the rolls 118 and 120 when the blade assembly pivots downwardly. A reversible motor 162 is mounted on one of the rails 158 and is connected to one of the arms 152 to pivot the blade assembly between an upper position in which the arms 152 engage bumpers 164 on the rails 158 and a lower position in which the blades 160 extend between the sleeves. Light springs 166 act between the arms 152 and rails 158 to aid the motor 162 in pivoting the blade assembly to its upper position.

The roll 118 and a roll 168 form a pair of thirty-second-fold rolls. The opposite ends of roll 168 are rotatably mounted on a pair of arms 170 which are pivotally mounted on the sides 112 and 114 by pins 141. The roll 120 is loosely mounted on the arms 170 or is mounted thereon through universal journals so that the opposite ends of the roll 168 can move relative to each other and the roll 168 can assume a canted position with respect to the roll 118. A spring 172 is anchored to the free end of each of the arms 170 and to the respective side wall 112 and 114 and acts on the arms 170 to bias the roll 168 toward and into engagement with the roll 118. The roll 168 is also provided with a plurality of sleeves 144 aligned with the sleeves 144 on the roll 118.

Stop blocks 174 are mounted on the side walls 112 and 114 in the path of movement of the arms 170 so that engagement between the stop blocks 174 and arms 170 will prevent engagement between the sleeves 144 on the rolls 118 and 168.

Figure 7:
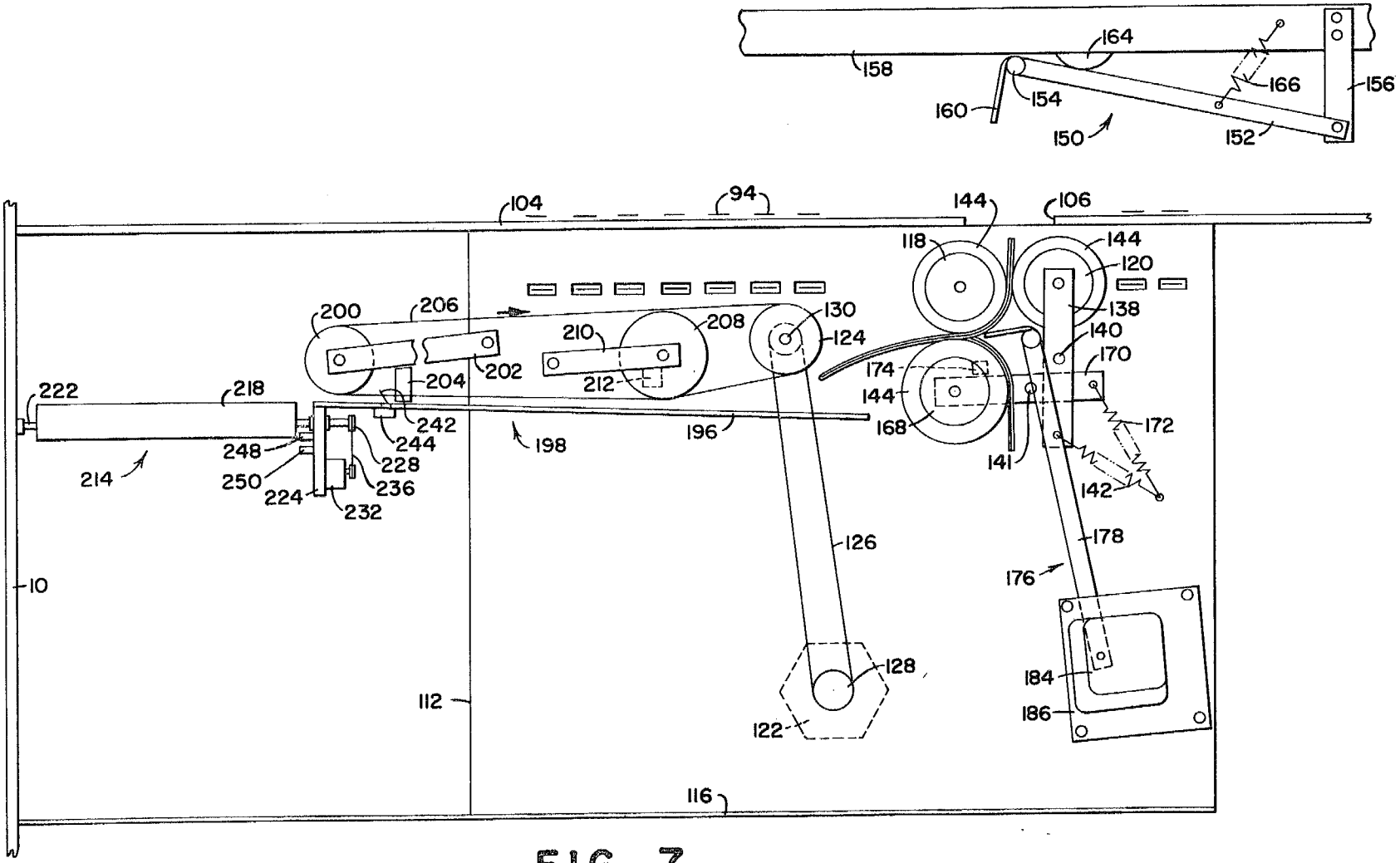
FIG. 7 is a sectional view taken substantially along the lines 7—7 of FIG. 1.

A thirty-second-fold oscillatory blade assembly indicated generally at 176 includes a pair of arms 178 interconnected at one end by a rod 180 and pivotally mounted at their opposite ends to the side walls 112 and 114. A plurality of spaced blades 182 are secured to the rod 180 for movement between the sleeves 144 on the rolls 118 and 168 when the blade assembly pivots toward the rolls 118 and 168. A reversible motor 184 is mounted on the side wall 112 through a bracket 186 and is connected to one of the arms 178 to pivot the blade assembly between a normal position illustrated in FIG. 8 and a position in which the blades 182 extend between the sleeves 144 on rolls 118 and 168 as illustrated in FIG. 7.

A pulley 188 is mounted on the roll 168 in alignment with the pulleys 134 and 136, and an idler pulley 190 is mounted on the side wall 114, also in alignment with the pulleys 134, 136 and 188. The endless flexible belt 132 is also trained about the pulleys 188 and 190 and extends about the pulley 188 in a direction opposite to that in which it extends about the pulley 136 so that the two rolls 118 and 168 are driven in opposite directions. The pulleys 134, 136 and 188 are positive drive pulleys and the belt 132 is a dual grip belt. That is, the pulleys are transversely grooved as shown at 192 in FIG. 9 and the belt is provided with cogs 194 on both sides, which extend into the grooves. This provides a positive drive for the rolls 136 and 188 and insures that they are driven at equal rates. The pulleys 134, 136 and 188 can take any form as long as they are provided with openings which are the functional equivalent of grooves for receiving the cogs on the belt.

The operation of the cross-fold portion of the machine is as follows: when the sheet or blanket, folded into eight panels, emerges from between the rolls 66 and 68, it is moved toward the front of the machine by the second conveyor. After a predetermined time, the timer mechanism will activate the reversible motor 162 to pivot the blade assemby 150 downwardly. The timer mechanism allows sufficient time for the sheet or blanket 92 to move into engagement with the stop bar 111. As the sheet or blanket moves toward the stop bar 111 it engages the finger 110 of switch 108 to open the switch which is wired in the circuit for the motor 162. This insures that the motor 162 cannot be activated until the trailing edge of the sheet or blanket has moved past the finger 110.

As the blade assembly 150 pivots downwardly, the blades 160 engage the sheet or blanket midway between its ends and force the sheet downwardly through the opening 106 and into the pinch point between the sleeves 144 on the rolls 118 and 120. As the sheet or blanket moves between the rolls 118 and 120 it is folded into sixteenths. The arms 138 permit the roll 120 to be forced away from the roll 118 so there is a sufficient gap between the sleeves 144 on the rolls 118 and 120 to allow the sheet or blanket to be moved therebetween and the loose or universal mounting between the roll 120 and arms 138 insures that all the sleeves 144 remain in contact with the material.

Figures 8, 9:
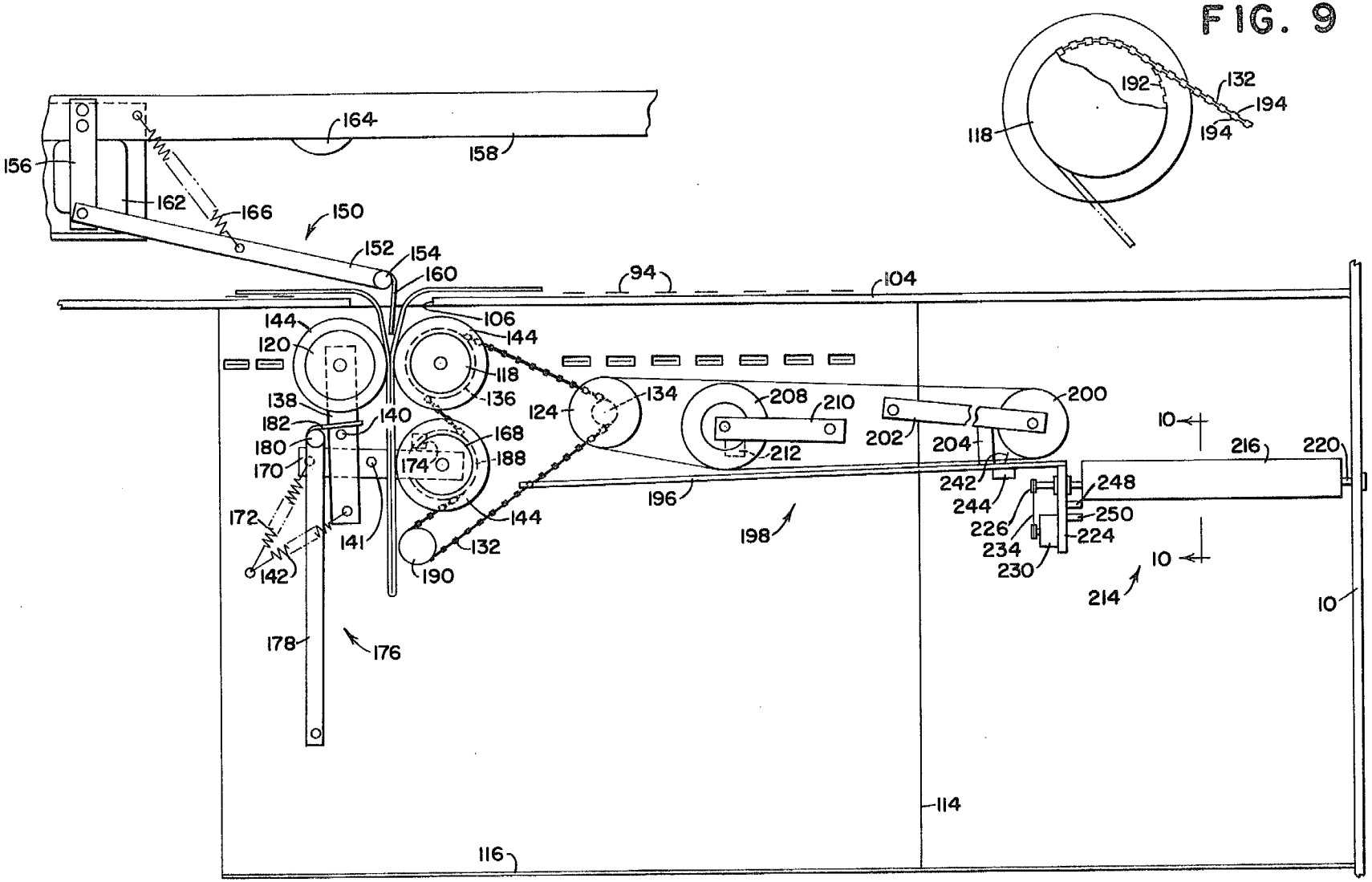
FIG. 8 is a sectional view taken substantially along the lines 8—8 of FIG. 1.
FIG. 9 is an enlarged view of a portion of the drive system illustrated in FIG. 8, parts being broken away for clarification purposes.

When approximately one-half of the sheet or blanket has been drawn between the rolls 118 and 120 and has moved past the blades 182 of the thirty-second-fold blade assembly 176 as illustrated in FIG. 8, the timer mechanism activates the reversible motor 184 to pivot the blade assembly 176 to the left as shown in FIG. 7 so that the blades 182 engage the sheet or blanket and move it into the pinch points formed by the sleeves 144 on the rolls 118 and 168. The stops 174 maintain a gap between the sleeves 144 on the rolls 118 and 168 so that the substantial thickness of thirty-two panels of the sheet or blanket does not interfere with the initial movement of the sheet or blanket between the rolls 118 and 168.

As the material moves between the sleeves 144 on the rolls 118 and 168, the pivoted arms permit the roll 168 to be forced away from the roll 168 so that there is a sufficient gap between the sleeves 144 on the rolls 118 and 168 to allow the sheet or blanket to be moved therebetween and the loose or universal mounting between the roll 168 and arms 170 insures that all the sleeves 144 remain in contact with the material. Flanges on the pulleys 136, 188 and 190 prevent the belt 132 from leaving the pulleys should the roll 168 assume a canted position as it is held against the material.

When the sheet or blanket 92, folded into thirty-two panels, emerges from between the rolls 118 and 168, it is deposited on a platform or table 196 which forms part of a conveyor and accelerator assembly indicated generally at 198.

When the timer mechanism is restarted by a new sheet engaging the finger 30 of the switch 28, the various blade assemblies will be returned to their original positions.

The table 196 of the conveyor assembly 198 is secured between the walls 112 and 114 of the roll support frame and has a hard, smooth, low-friction upper surface. The forward or receiving end of the table 196 is located close to and slightly below the egress from the rolls 118 and 168 and is positioned at an upward slant from its receiving end to its rear or discharge end.

The roller 124 forms part of the conveyor and is located close to the forward end of the table. Another roller 200 is located adjacent the rear edge of the table 196. The roller 200 is mounted on the free ends of a pair of arms 202 which are pivotally mounted on the walls 112 and 114. Downward movement of the roller 200 is limited by stops 204 which contact the arms 202 and hold the roller 200 just above the table. A plurality of rough-surfaced belts 206 are trained about the rollers 124 and 200 and are driven by the roller 124. An additional roller 208 is mounted between the rollers 124 and 200 by a pair of arms 210 which are pivotally mounted on the walls 112 and 114. Downward movement of the roller 208 is limited by stops 212 which contact the arms 210 and hold the roller 208 just above the table. The roller 208 is normally closer to the table than the roller 124 and is of larger diameter than the rollers 124 and 200.

As can be seen in FIG. 8, the pulley 134 on the roller 124 is of smaller diameter than the pulleys 136 and 188 on the rolls 118 and 168. This causes the belts 206 to be driven at a faster speed than the rolls 118 and 168. In a preferred embodiment of the invention the speed of the belts 206 with respect to the speed of the rolls 118 and 168 is in the approximate ratio of 4 to 3.

Figure 10:
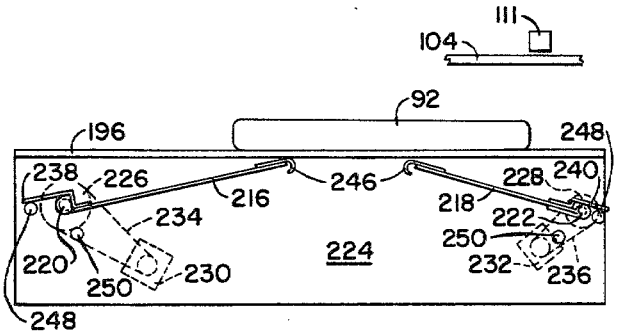
FIG. 10 is a sectional view taken substantially along the lines 10—10 of FIG. 8.

The conveyor 198 delivers the folded sheet or blanket to a stacker indicated generally at 214. The stacker includes a pair of drop doors 216 and 218 which are secured to shafts 220 and 222, each having one end journaled in a side wall 10 and the other end extending through and journaled in a support wall 224 depending from the discharge end of the table 196. The ends of the shafts 220 and 222 which extend through the wall 224 are provided with pulleys 226 and 228 and are driven by stalled, permanent split capacitor, reversible motors 230 and 232, respectively, through belts 234 and 236. The motors are normally activated to hold the doors in an up position as illustrated in FIG. 10. The doors 216 and 218 are counterweighted as at 238 and 240, respectively, so that motors with smaller capacitors can be utilized to prevent overheating. The motors 230 and 232 are controlled by the timer mechanism which reverses the motors a predetermined time after the sheet or blanket has passed over the finger 242 of a switch 244 mounted on the table 196.

When the drop doors are in their normal up position they extend inwardly and upwardly from their axes to adjacent inner edges, and the upper, upper edges of the doors are provided with lip members 246 which present smooth upper surfaces. Also, as can be seen in FIG. 10, when the drop doors are in their up position the upper inner edges are spaced apart.

The door 216 has a greater dimension from pivot to inner edge than does the door 218, and the pivot for the door 216 is higher than the pivot for the door 218 and the door 216 assumes a lesser angle than does the door 218. Because of the different relative dimensions of the doors 216 and 218, the gap left by the spaced-apart inner edges of the doors is positioned closer to the pivot of the door 218 than to the pivot of the door 216. This offset gap insures that smaller sizes of sheets will not prematurely fall through the gap. For example, the material being folded always moves through the left-hand portion (as seen in FIG. 1) of the cross-fold rolls since it moves into engagement with the stop bar 111 (see FIGS. 1 and 10). Because of this the folded material will be positioned over almost the complete door 218. When a regular size sheet is folded its one edge only slightly overlaps the inner edge of the door 216. If the gap were centered the one edge of the sheet may fall through the gap.

The purpose of the gap between the doors is to permit the use of doors of minimum dimension so as to require a minimum vertical distance between the top of the stacked material and the pivot axes of the door for the doors to move to their open position. This helps achieve a stack of maximum height without increasing the dimensions of the overall folder. The pivot for the door 216 is higher than the pivot for the door 218 to compensate for the larger size door and maintain the maximum distance between the doors when in the lowered position and the platform below the doors.

The up and down positions of the doors 216 and 218 are determined by stops 248 and 250 mounted on the wall 224 in the path of movement of the doors.

Since the door 216 is of a larger dimension than the door 218 it must move about its pivot axis slower than the door 218 moves about its pivot axis in order to maintain approximately equal drop speeds of the inner edges of the doors. This is achieved by utilizing a pulley 226 which is larger than the pulley 228. Of course the same result could be obtained by properly sizing the pulleys on the motors.

The operation of the conveyor and stacker is as follows: when the folded sheet or blanket emerges from between the folding rolls 118 and 168 its leading edge moves onto the table and under this roller 124 until caught by the belts 206. The driven folding rolls 118 and 168 push the material into the pinch point between the table 196 and belts 206. The distance the sheet or blanket has to move on the table before caught by the belts 206 depends upon its thickness and the roller 124 is spaced a sufficient distance above the table to permit the thickest anticipated piece of material to pass thereunder.

When the belts 206 engage the material they pull the material along the table and under the rollers 208 and 200. The moveable rollers 208 and 200 insure that the belts 206 engage the material and yet provide the clearance necessary for the material to pass thereunder. The oversized diameter of the roller 208 insures that the belts 206 maintain the necessary tension for proper driving engagement with the roller 124 by moving the upper runs of the belts 206 out of a straight between the rollers 124 and 200 by an amount equal to that which the lower runs move into alignment as the material passes thereunder. If the conveyor is made sufficiently short it is possible to omit the roller 208 and still obtain satisfactory results.

Since the belts 206 are driven at a greater speed than the rolls 118 and 168 they will slip on the folded material until such time as the material is completely free from the rolls. However, when slipping, the belts do pull on the material and this tends to remove wrinkles from the material and give it an ironed look.

Because of the speed at which the belts 206 are driven, the conveyor tends to accelerate the folded material and ejects it onto the drop doors of the stacker. As the material enters onto the doors it takes a slight fold as it conforms to the contour of the closed doors. This slight fold provides additional rigidity to the folded material so that the conveyor can provide a push to the material and aid inertia in moving the material onto the doors. As the material passes off the finger 242 of the switch 244 the timing mechanism is started to reverse the motors 230 and 232 as soon as sufficient time for the material to move completely onto the doors has elapsed.

When the motors are reversed the doors 216 and 218 pivot downwardly against the stops 250 and permit the folded sheet or blanket to drop onto a platform. In the illustrated embodiment the platform is a continuation of the bottom wall 116 of the roll support frame. If desired, the platform could be replaced with a conveyor which in turn could be controlled manually or through a counter so that stacks of material could be easily removed from under the drop doors.

Having thus provided a detailed description of a preferred embodiment of the invention, the advantages of the invention should be readily apparent to those skilled in the art. Various modifications within the spirit and scope of the invention will also be apparent to those skilled in the art, and these obvious modifications can be incorporated into the invention without departing from the underlying principles of the invention. Therefore, the invention should not be limited to the specific illustration and description, but only to the reasonable scope of the following claims.

We claim:

1. A material-folding machine comprising: a frame; a pair of cooperating folding rolls rotatably supported on the frame with a first of the pair rotatable about a fixed axis and a second of the pair rotatable about an axis mounted for movement in an arcuate path toward and away from the first; means yieldably biasing the second of the pair of folding rolls toward the first thereof; oscillatory blade means supported on the frame for movement into engagement with material between the blade means and the pair of folding rolls to move the material between the pair of folding rolls; and a single positive drive means for the pair of folding rolls including a transversely grooved pulley mounted on each of the pair of folding rolls at common ends thereof, an idler pulley mounted on the frame for rotation in a fixed position and in alignment with the grooved pulleys and on the side of the grooved pulley mounted on the second of the pair of folding rolls opposite from the pulley mounted on the first of the pair of folding rolls, a drive pulley mounted on the frame in alignment with and spaced from the first three mentioned pulleys for rotation in a fixed position, and a flexible dual grip drive belt having cogs on the opposite sides thereof spaced to engage in the grooves of the pulleys trained about the pulleys and about the pulley mounted on the one of the pair of folding rolls in a direction opposite from which it trained about the other pulleys.

2. A folding machine as set forth in claim 1 wherein accelerator-conveyor means is supported on the frame, receives the material passing between the pair of folding roll means and delivers the same to a stacker positioned at the end thereof.

3. A folding machine as set forth in claim 2 wherein said accelerator-conveyor means comprises a smooth-surfaced table having receiving and discharge ends, a pair of rollers mounted on the frame above and at the receiving and discharge ends of the table, a plurality of belts trained about the rollers with the lower runs thereof positioned adjacent the table to frictionally engage material fed onto the table from the pair of folding rolls, and means for driving one of the rollers.

4. A folding machine as set forth in claim 3 wherein the roller adjacent the receiving end of the table is driven, the drive pulley is mounted on and driven by the roller adjacent the receiving end of the table, and the drive pulley is of smaller diameter than the grooved pulleys on the folding rolls.

5. A folding machine as set forth in claim 4 wherein the drive pulley is a grooved pulley.

6. A folding machine as set forth in claim 3 wherein the smooth-surfaced table is inclined upwardly from the receiving to the discharge end to elevate the folded material in the process of delivering it to the stacker.

7. In a material-folding machine having frame means supporting a plurality of pairs of cooperating folding rolls and a plurality of oscillatable blade means for introducing material to be folded between the cooperating folding rolls, a stacking mechanism comprising: a smooth-surfaced table having receiving and dischage ends supported by the frame with the receiving end in a position to receive the folded material emerging from the last pair of cooperating folding rolls; a roller mounted on the frame at each of the receiving and discharge ends of the table in parallelism to the last pair of cooperating folding rolls and slightly above the table; means for driving one of the rollers; belt means trained about the rollers to frictionally engage the folding material fed onto the receiving end of the table from the last pair of cooperating folding rolls and move the material to and beyond the discharge end of the table; a pair a pair of drop door means supported on the frame adjacent the discharge end of the table to receive the folded material from the table, each of the pair of door means being mounted for movement between open and closed positions about a generally horizontal axis parallel to the direction of movement of the folded material on the table and outside the area covered by the material when on the door means, and the pair of door means each extending from its respective axis inwardly and upwardly to an inner edge positioned adjacent to the other door means when in the closed positioned; motor means controlling the door means and normally holding them in the (a) closed position; sensor means on the discharge end of the table for sensing the passage of material thereover to activate the motor means and drop the door means when the material has completely passed off the table; and platform means supported on the frame below the door means to receive the folded material dropped by the door means.

8. The mechanism as set forth in claim 7 wherein the belt means is driven at a faster rate than the last of the pair of cooperating folding rolls.

9. The mechanism as set forth in claim 7 wherein the smooth-surfaced table is inclined upwardly from its receiving to its discharge end to elevate the folded material as it is being delivered to the pair of drop door means.

10. A material-folding machine as set forth in claim 7 wherein each of the last pair of folding rolls is driven from the driven roller and is driven at a peripheral speed less than that at which the roller is driven.

11. The mechanism as set forth in claim 7 wherein the inner adjacent edges of the pair of door means are spaced from each other when in the closed position.

12. The mechanism as set forth in claim 11 wherein one of the pair of door means is of a greater dimension between its axis and inner edge than is the other so that the gap between the two door means is offset from a center position between the axes of the door means.

13. The mechanism as set forth in claim 12 wherein the door means having the greater dimension between its axis and inner edge moves about an axis positioned higher than the axis of the other door means and extends upwardly at a lesser angle than does the other door means.

14. The mechanism as set forth in claim 13 wherein the motor means controlling the door means move the door means between open and closed positions and drive the door means having the greater dimension between its axis and inner edge at a slower rotational speed than the other door means to move the inner edges of the door means at a substantially equal rate.

15. The mechanism as set forth in claim 11 wherein counterweight means is secured to each of the doors to partially balance the doors on their axes of movement.

16. A material-folding machine as set forth in claim 7 wherein each of the last pair of folding rolls is provided with a transversely grooved pulley on common ends thereof, a drive pulley is mounted on a corresponding end of the driven roller, an idler pulley is mounted on the frame in alignment with the pulleys on the last pair of folding rolls and on the driven roller and on the side of one of the grooved pulleys opposite from the other grooved pulley, a drive belt is trained about the pulleys and about the one of the grooved pulleys in a direction opposite from which it is trained about the other pulleys, and the drive belt is a dual grip belt having cogs on the opposite sides thereof spaced to engage in the grooves of the grooved pulleys.

17. In a material-folding machine having frame means supporting a plurality of pairs of cooperating folding rolls, a plurality of oscillatable blade means for introducing material to be folded between the cooperating folding rolls, a conveyor means supported by the frame means for receiving folded material from the last of the pairs of cooperating folding rolls and delivering the same to a stacker, the stacker comprising: a pair of drop doors pivotally mounted on the frame means for movement about respective axes between closed and open positions; the axes of the respective doors extending generally parallel to the direction of movement of the folded material on the conveyor and being positioned with one end of each near the respective side of the conveyor; each of the doors when in the closed position extending generally inwardly toward the other door and upwardly from its axis to its inner edge; motor means for driving the doors about their respective axes between the open and closed position and for driving one of the doors about its axis at a faster rotational speed than the other door; the inner adjacent edges of the doors being spaced apart when in the closed position to provide a gap therebetween; the one of the doors having a greater dimension between its axis and inner edge than the other door whereby the gap between the inner adjacent edges of the doors when in the closed position is offset from the center between the axes of the doors and the inner edges of the doors move at substantially the same speed when moving between the open and closed positions.

18. The folding machine as set forth in claim 17 wherein the doors of the stacker are mounted on the frame in a position higher than the egress from the last pair of the cooperating folding rolls and the conveyor elevates the folded material to the stacker.

19. The folding machine as set forth in claim 17 wherein the doors extend beyond both sides of their respective pivots to reduce the force needed to move the doors about their respective pivots.

* * * * *